US010818274B2

(12) United States Patent
Glasser

(10) Patent No.: US 10,818,274 B2
(45) Date of Patent: Oct. 27, 2020

(54) APPARATUS AND METHODS FOR CARBON COMPOSITE STRINGED INSTRUMENTS

(71) Applicant: Andrew Glasser, Bronx, NY (US)

(72) Inventor: Andrew Glasser, Bronx, NY (US)

( * ) Notice: Subject to any disclaimer, the term of this patent is extended or adjusted under 35 U.S.C. 154(b) by 0 days.

(21) Appl. No.: 15/603,125

(22) Filed: May 23, 2017

(65) Prior Publication Data

US 2017/0337905 A1 Nov. 23, 2017

Related U.S. Application Data

(60) Provisional application No. 62/340,190, filed on May 23, 2016.

(51) Int. Cl.

| | |
|---|---|
| ***G10D 1/00*** | (2020.01) |
| ***B68B 1/00*** | (2006.01) |
| ***G10D 3/22*** | (2020.01) |
| ***G10D 1/02*** | (2006.01) |

(52) U.S. Cl.
CPC ..... *G10D 3/22* (2020.02); *G10D 1/02* (2013.01)

(58) Field of Classification Search
CPC ..... G10D 1/005; G10D 1/085; G10D 1/02; G10D 1/08; G10D 1/06; G10D 1/00; G10D 3/22; B68G 1/00
See application file for complete search history.

(56) References Cited

U.S. PATENT DOCUMENTS

| | | | | |
|---|---|---|---|---|
| 3,699,836 | A | 10/1972 | Glasser | |
| 3,880,040 | A | 4/1975 | Kaman | |
| 4,313,362 | A | 2/1982 | Lieber | |
| 4,334,452 | A | 6/1982 | Morrison et al. | |
| 4,348,933 | A | 9/1982 | Kaman et al. | |
| 4,353,862 | A | 10/1982 | Kaman, II | |
| 4,364,990 | A | 12/1982 | Haines | |
| 4,506,053 | A * | 3/1985 | Sakurai | C08K 3/0033 524/398 |
| 4,873,907 | A | 10/1989 | Decker et al. | |
| 4,969,381 | A | 11/1990 | Decker et al. | |
| 5,125,312 | A | 6/1992 | Fishman et al. | |
| 5,153,363 | A * | 10/1992 | Fishman | G10D 3/22 84/731 |
| 5,616,873 | A * | 4/1997 | Fishman | G10D 1/005 84/293 |
| 6,100,458 | A | 8/2000 | Carrington et al. | |
| 6,294,718 | B1 | 9/2001 | Saunders, Jr. et al. | |
| 6,657,113 | B2 * | 12/2003 | Herman | G10D 1/005 84/293 |
| 6,676,882 | B2 | 1/2004 | Benson et al. | |
| 6,683,236 | B2 | 1/2004 | Davis et al. | |
| 6,774,292 | B2 | 8/2004 | Mace | |
| 7,276,868 | B2 * | 10/2007 | Allred, III | G10D 1/005 318/294 |

(Continued)

*Primary Examiner* — Lawrence Averick

(74) *Attorney, Agent, or Firm* — J. Curtis Edmondson; Law Offices of J. Curtis Edmondson

(57) ABSTRACT

A method of producing and assembling carbon composite based stringed musical instruments. The assembled stringed musical instrument is relatively inexpensive, extremely sturdy, light weight and simulates tones as deep and resonant as obtained by any other wood based instruments. The method also provides for manufacturing geometrically identical stringed musical instruments and the method being adaptable for producing and assembling any stringed musical instrument.

12 Claims, 28 Drawing Sheets

(56) References Cited

U.S. PATENT DOCUMENTS

| | | | | |
|---|---|---|---|---|
| 8,487,052 | B2 * | 7/2013 | Kobayashi | C08F 283/10 428/413 |
| 9,818,380 | B2 * | 11/2017 | Luttwak | G10D 3/04 |
| 9,911,401 | B2 * | 3/2018 | Austin | G10D 1/005 |
| 2003/0140765 | A1 * | 7/2003 | Herman | G10D 1/005 84/314 R |
| 2005/0058869 | A1 * | 3/2005 | Mathias | H01M 4/8807 429/480 |
| 2012/0134823 | A1 * | 5/2012 | Tully | F03D 1/0625 416/131 |
| 2012/0252930 | A1 * | 10/2012 | Kobayashi | C08F 283/10 523/400 |
| 2014/0144306 | A1 * | 5/2014 | Seal | G10D 1/005 84/291 |
| 2015/0130261 | A1 * | 5/2015 | Warren | B60B 5/02 301/64.101 |
| 2015/0135930 | A1 * | 5/2015 | Luttwak | G10D 3/04 84/307 |
| 2016/0023068 | A1 * | 1/2016 | Billings | A63B 53/0487 473/314 |
| 2016/0063968 | A1 * | 3/2016 | Seal | G10D 3/06 84/291 |
| 2017/0011718 | A1 * | 1/2017 | Austin | G10D 1/005 |

* cited by examiner

APPARATUS AND METHODS FOR CARBON COMPOSITE STRINGED INSTRUMENTS

REFERENCE TO RELATED APPLICATIONS

This application claims an invention which was disclosed in Provisional Application No. 62/340,190, filed May 23, 2016, entitled "Apparatus and Methods for Carbon Composite Stringed Musical Instruments". The benefit under 35 U.S.C. § 119(e) of the U.S. provisional application is hereby claimed, and the aforementioned application is hereby incorporated herein by reference.

FIELD

The inventive subject matter relates to carbon composite components. More particularly the inventive subject matter pertains to stringed musical instruments made of layers of carbon fiber and resin with a core and base layer of specific material, and methods of making such components.

BACKGROUND

Carbon fiber composites have been put to use in many applications for decades including musical instruments. Carbon fiber has a high stiffness to mass ratio and the manufacturing process lending itself well to shell structures. Therefore, carbon fiber composites are an obvious choice for an alternative to wood components in stringed instruments.

Carbon fiber, being a good substitute for wood, has several advantages. Carbon composites based instruments allow for manufacturing instruments with specific properties which can be made repeatable in all the manufactured pieces. Carbon composite based musical instruments are not subject to dimensional variation from changing temperature and humidity, unlike wood based instruments which are very sensitive to environmental changes. Also, the carbon composite instruments are light weight and stronger, making them easier to transport and are much less likely to be damaged during shipping. Finally, composite based musical instruments avoid using endangered species of wood that are becoming more difficult to find.

Several examples of stringed instruments not made from wood and including carbon fiber are:

U.S. Pat No. 3,699,836 issued to Glasser describes a violin constructed from resin. U.S. Pat No. 3,880,040 issued to Kaman describes a guitar having a sound board made of layers of graphite fiber and a wood core. U.S. Pat No. 4,334,452 issued to Morrison describes a plastic musical instrument body having a structural insert. U.S. Pat No. 4,313,362 issued to Lieber describes an electric guitar with plastic construction. U.S. Pat No. 4,348,933 issued to Kaman et al. describes a sound board assembly made of carbon composites for use in a piano or the like. U.S. Pat No. 4,364,990 issued to Haines describes a construction material for stringed musical instruments using card board or paper core covered in carbon fiber material. U.S. Pat No. 4,873,907 and U.S. Pat No. 4,969,381 issued to Decker Jr. et al describe composite materials acoustic stringed musical instrument.

Accordingly, there remains a continual need for improved apparatus and methods for a construction of stringed musical instrument with carbon composite as a base. Additionally, it would be desirous if the same fine-tuning control can be achieved in the carbon composite based musical instruments as any other traditional wood based stringed musical instrument. It is to these and other improvements that preferred embodiments of the present inventive subject matter are generally directed.

SUMMARY

An object of the present inventive subject matter in one of the embodiments is to describe a stringed musical instrument made from carbon composite material. Another object of the present inventive subject matter is to provide a method for producing most of the components of the stringed musical instrument based on carbon composite materials. Still another object of the present inventive subject matter is to provide a method for assembling the components of the stringed musical instrument based on carbon composite materials. In another object of the inventive subject matter is to provide a method for assembling a stringed musical instrument made from carbon composite material is described. Yet another object of the inventive subject matter is to provide a relatively inexpensive stringed musical instrument based on carbon composite components which simulates tones as deep and resonant as obtained by other wood based instruments. Yet another object of the inventive subject matter is to provide a stringed musical instrument which is substantially stronger than a wood based musical instrument. In still yet another object of the inventive subject matter is to provide a method for manufacturing geometrically identical stringed musical instrument which is substantially stronger than a wood based musical instrument and also the method being adaptable for any kind of string musical instrument. These and other embodiments are described in more detail in the following detailed descriptions and the figures. The foregoing is not intended to be an exhaustive list of embodiments and features of the present inventive subject matter. Persons skilled in the art are capable of appreciating other embodiments and features from the following detailed description in conjunction with the drawings.

LIST OF SELECTED REFERENCE CHARACTERS

110-142: Represents the components and steps associated with prepreg foam.

200A-200M: Represents the steps associated with preform.

205-266: Represents the components and steps associated with preform.

310-330: Represents the components and steps associated with assembling of bass bar.

410-431: Represents the components and steps associated with assembling of a neck component.

510-541: Represents the components and steps associated with assembling of a top and bottom plates.

DETAILED DESCRIPTION

The present inventive subject matter is shown in reference for manufacturing a violin. Other stringed musical instruments such as a viola, cello, bass, guitar, sitar and the like may be beneficially produced and assembled in accordance with the principles of the inventive subject matter.

Carbon fiber is made from a common industrial fiber called polyacrylonitrile fiber. These fibers are woven into fabric with various weave patterns. The inventive subject matter described herein uses 3K carbon fiber fabrics (3000 filaments per fiber). Carbon fiber is further pre-impregnated with epoxy and is called "pre-preg". The pre-preg used is unidirectional, meaning it has been spread out onto backing paper. The core mainly constitutes a low density expandable epoxy foam.

The different steps involved in the method for (i) making the different components, (ii) assembling and (iii) setting up the stringed musical instrument are as described below with particular reference to the making of a violin. Other stringed musical instruments such as a viola, cello, bass, guitar, sitar and the like may be beneficially produced and assembled in accordance with the principles of the inventive subject matter.

The first step involves cutting and kitting of prepreg and foam. An improved cutting accuracy reduces the number of design changes that would be required at the production facility because of cutting errors. At this stage, itself one has to evaluate trim cover designs while they are being prototyped and make sure that the parts will be identical in production. This mainly helps in saving time to cut the porotypes in identical shapes and measurements. In a preferred embodiment, the cutting process may be atomized by using computer based cutting technology like Auto Metrix instruments.

The expandable foam is stored in a freezer prior to use and thawed for 20-25 minutes before preparing the foam for cutting purposes. The 4/4 mold is measured for its height and breadth and an expandable foam sheet is prepared to be cut accordingly.

Figure 1A:
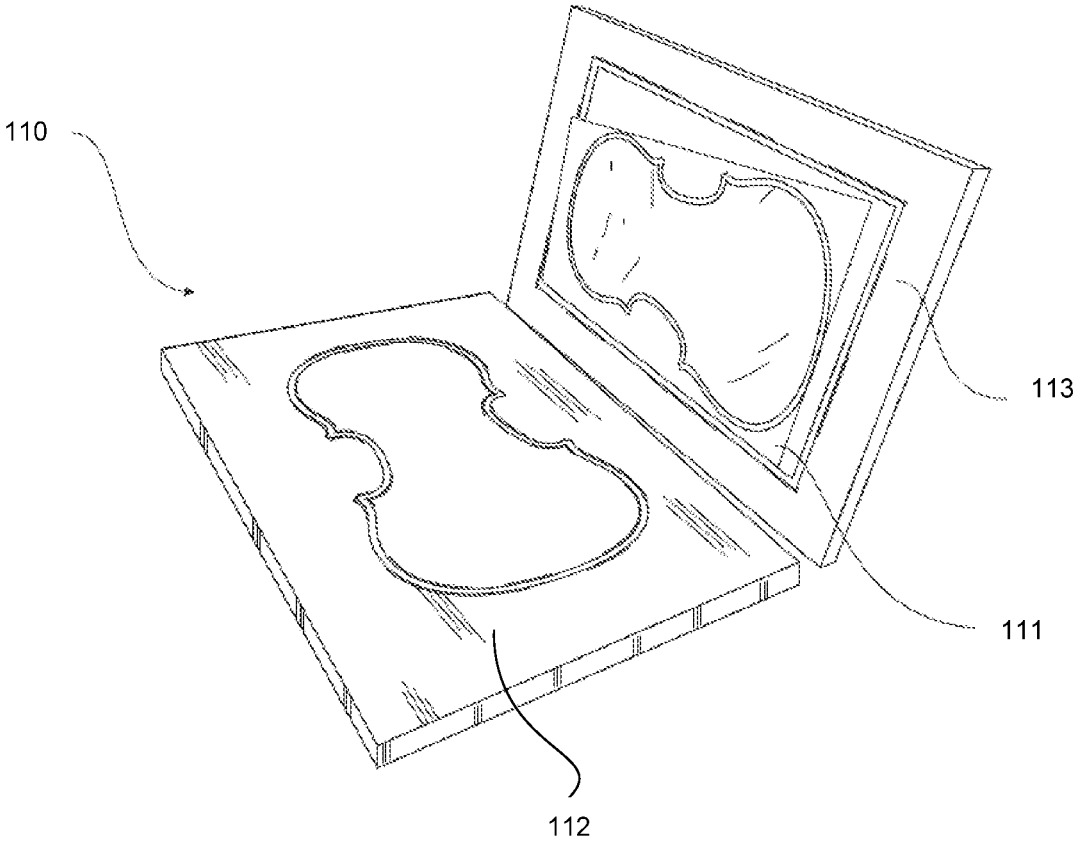
FIG. 1A: Pictorial illustrations of the steps involved in cutting and kitting prepreg and foam.
Figure 1B:
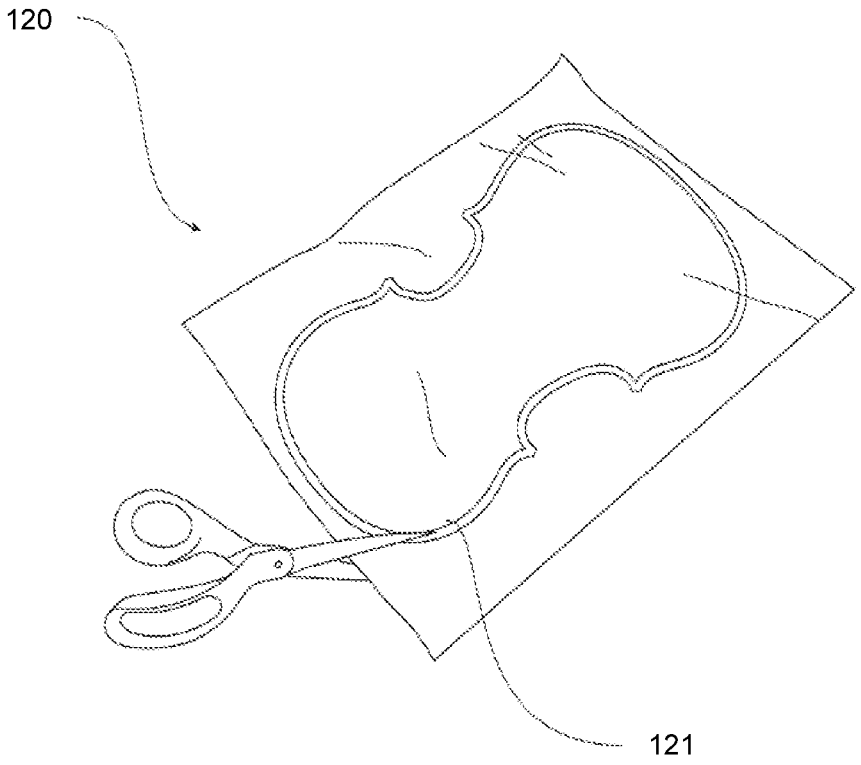
FIG. 1B: Pictorial illustrations of the steps involved in cutting and kitting prepreg and foam.
Figure 1C:
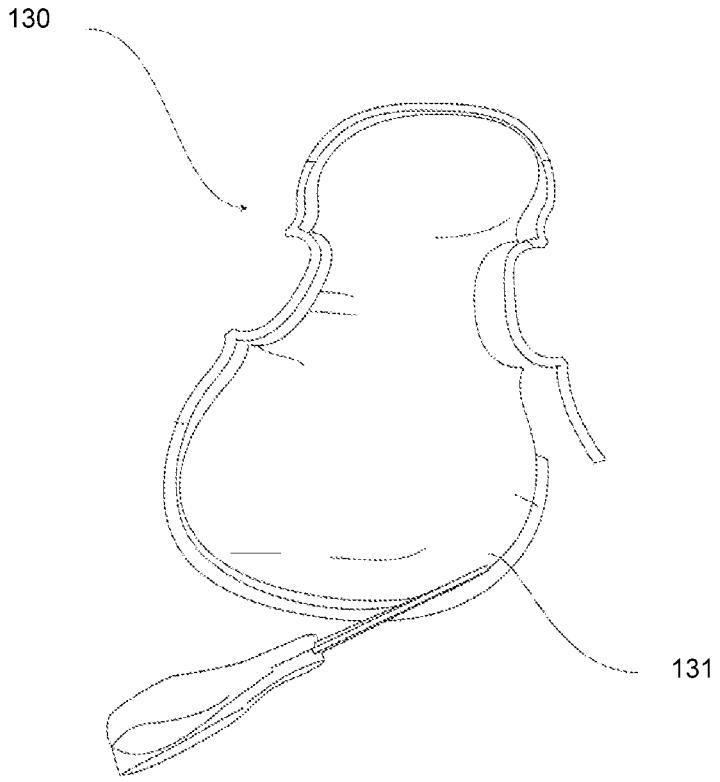
FIG. 1C: Pictorial illustrations of the steps involved in cutting and kitting prepreg and foam.
Figure 1D:
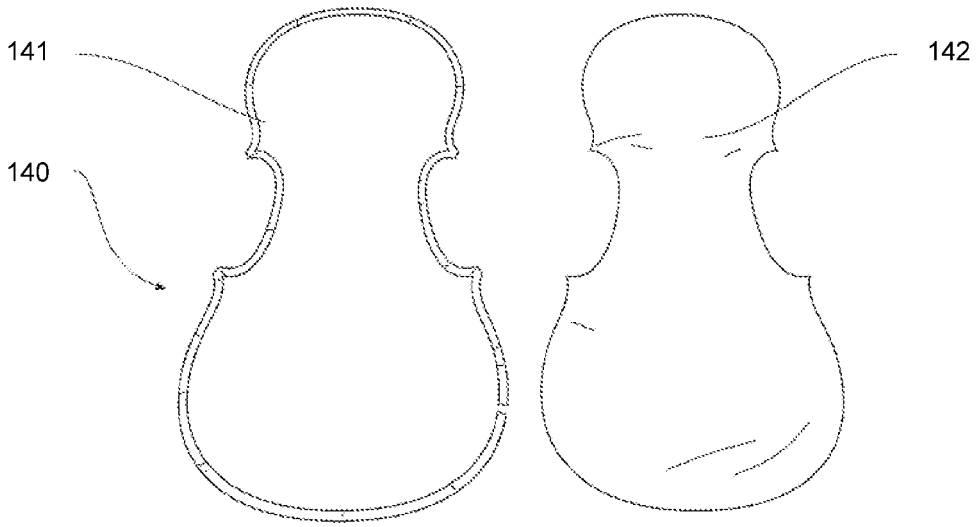
FIG. 1D: Pictorial illustrations of the steps involved in cutting and kitting prepreg and foam.

A rectangular piece of the expandable foam material 111 is cut and placed on the bottom plate of the 4/4 aluminum mold 112 followed by the top plate 113 and the whole set up is cured so as to get a definite impression of the outline of the body of the violin including the outer and inner outlines as shown in 110 of FIG. 1A. The expandable foam material is cut on the outer out line 121 as shown in 120 of FIG. 1B and the inner outline 131 as shown in 130 of FIG. 1C. The strip cutout 141 is separated from the body piece cutout 142 of the violin as shown in 140 of FIG. 1D.

Figure 2:
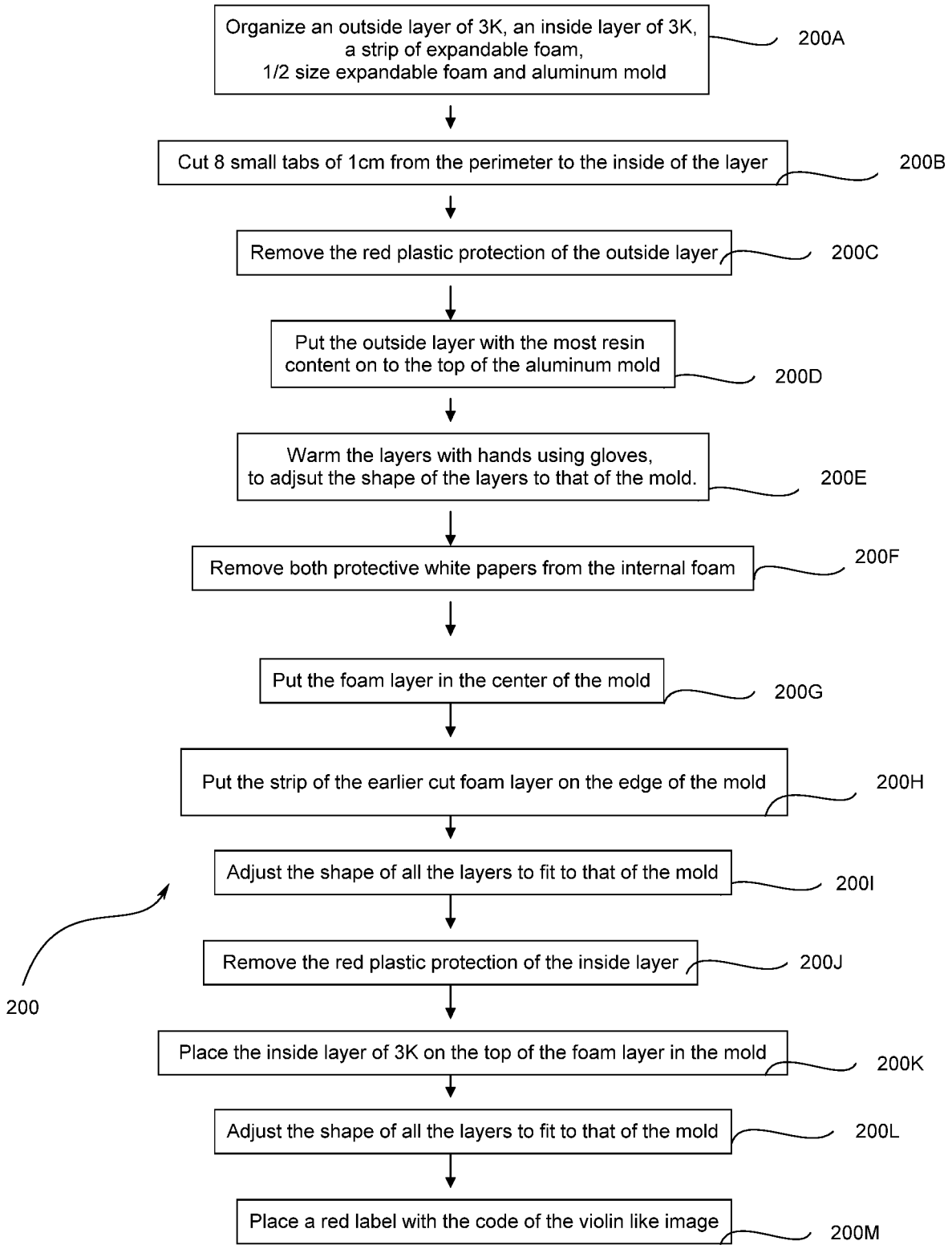
FIG. 2: Illustrates Process Flow chart.
Figure 2A:
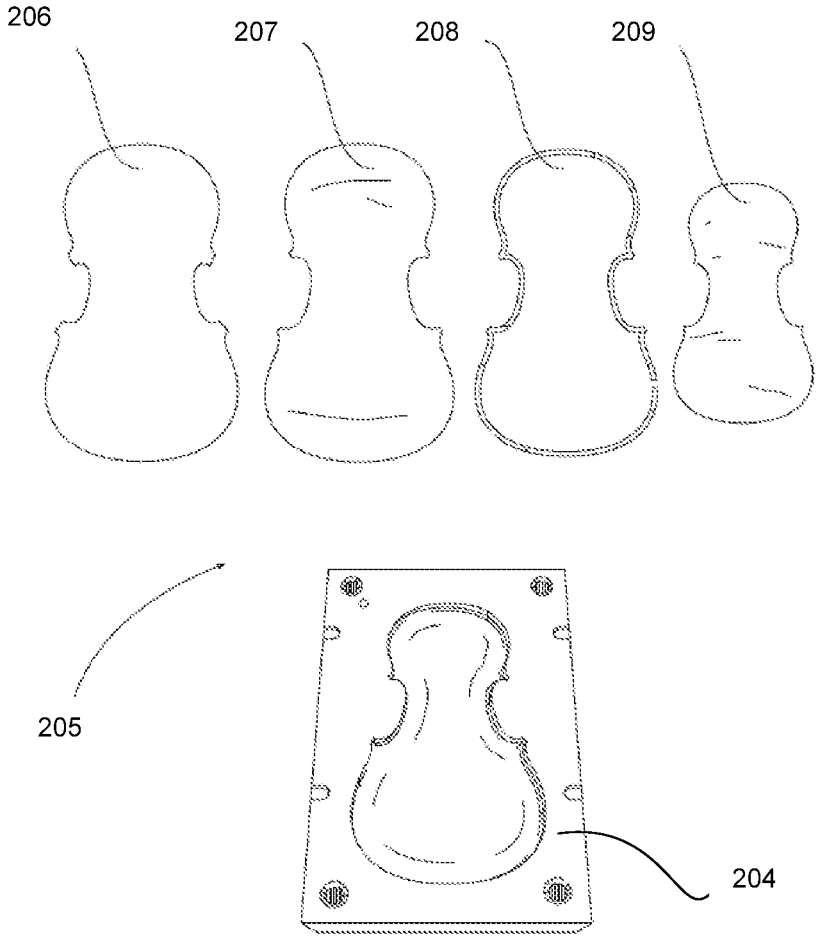
FIG. 2A: Pictorial illustrations of the steps involved in preform.
Figure 2B:
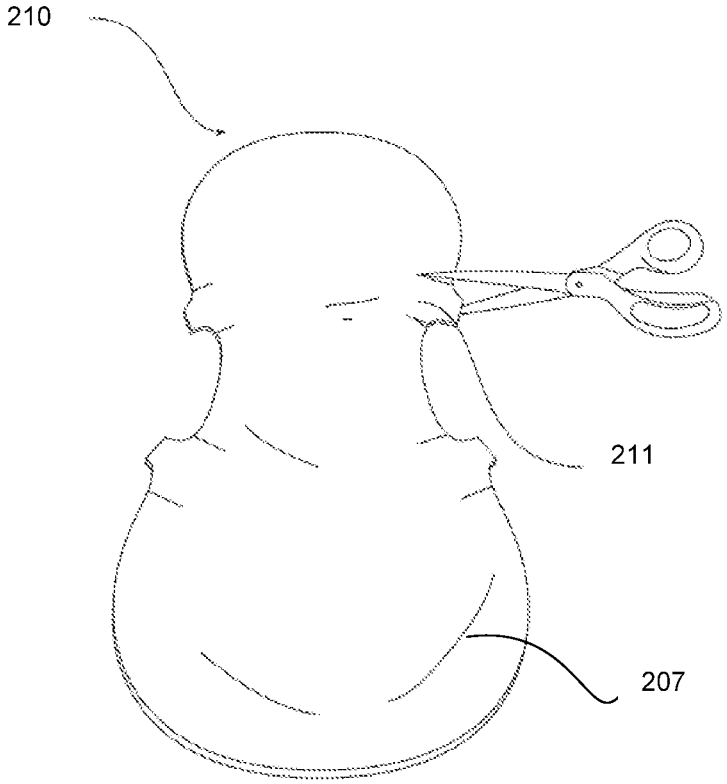
FIG. 2B: Pictorial illustrations of the steps involved in preform.
Figure 2C:
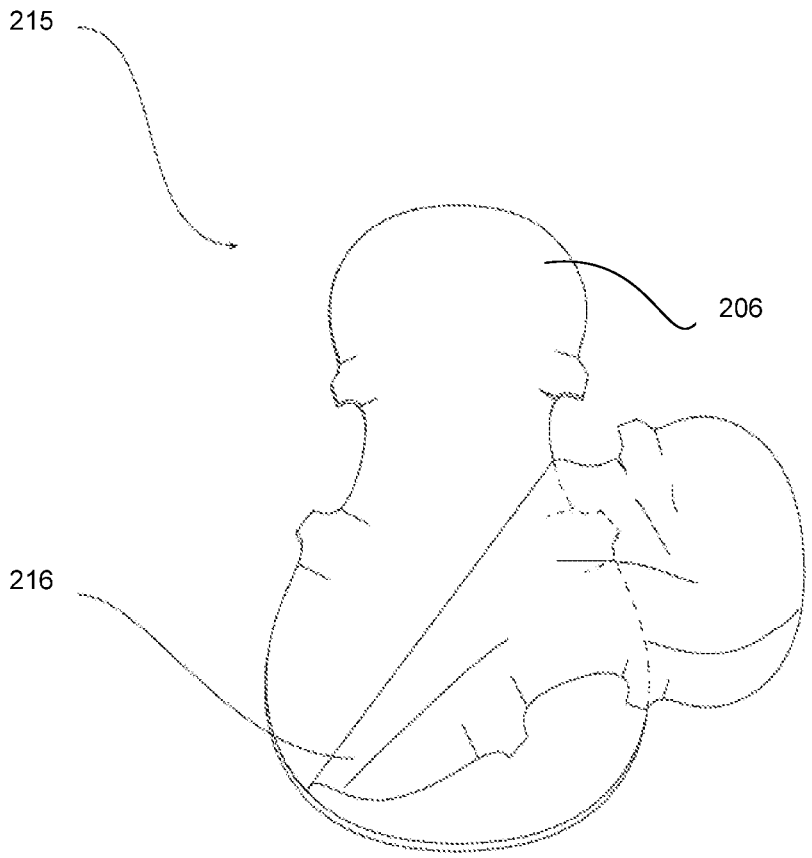
FIG. 2C: Pictorial illustrations of the steps involved in preform.
Figure 2D:
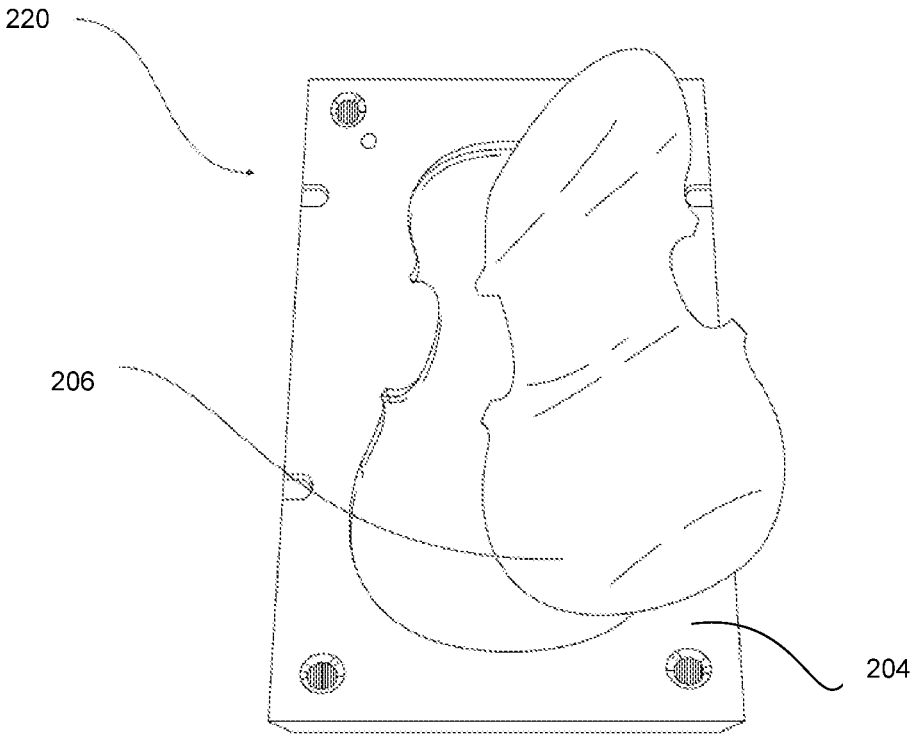
FIG. 2D: Pictorial illustrations of the steps involved in preform.
Figure 2E:
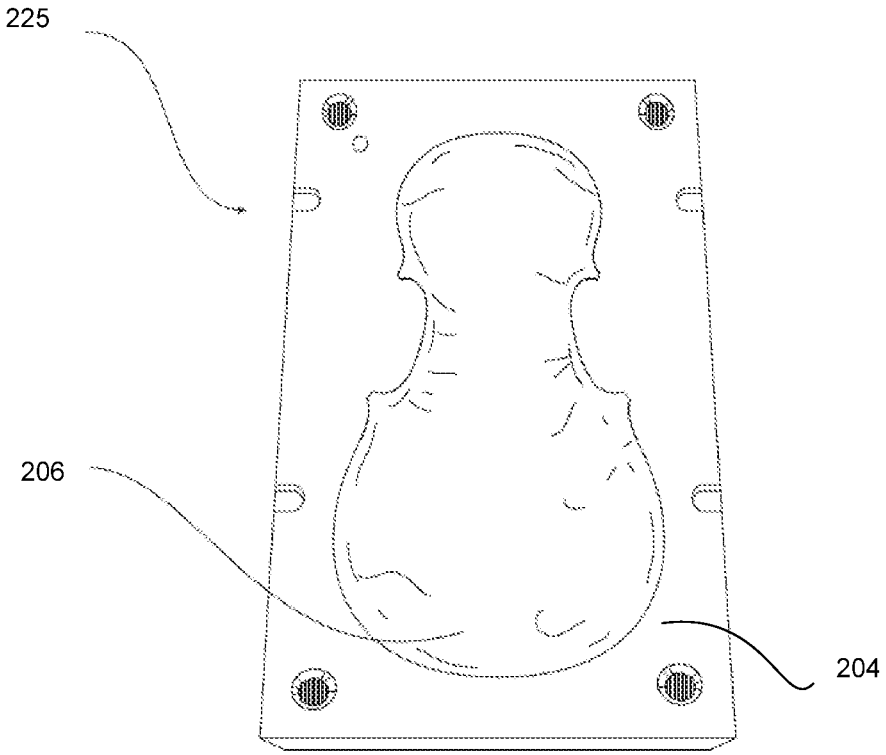
FIG. 2E: Pictorial illustrations of the steps involved in preform.
Figure 2F:
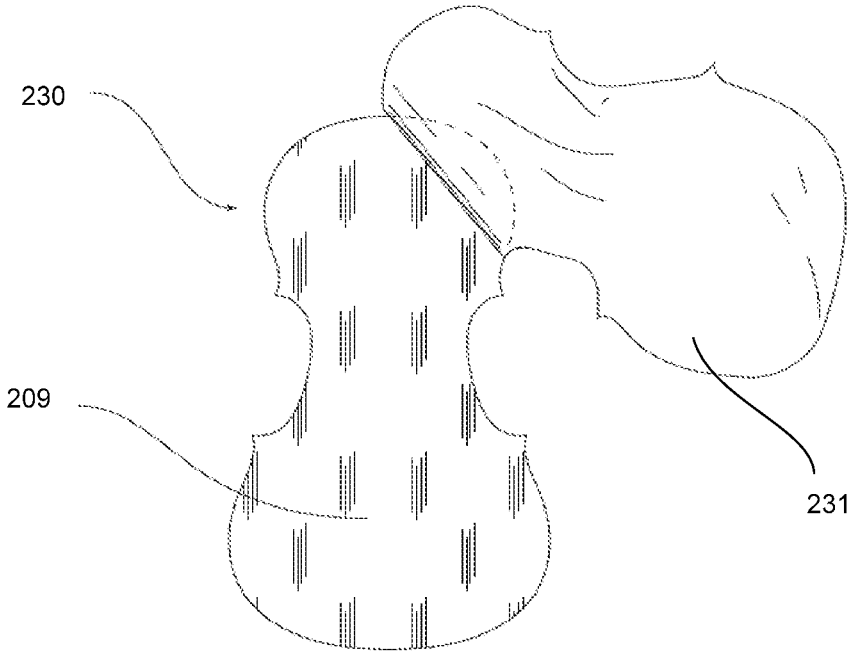
FIG. 2F: Pictorial illustrations of the steps involved in preform.
Figure 2G:
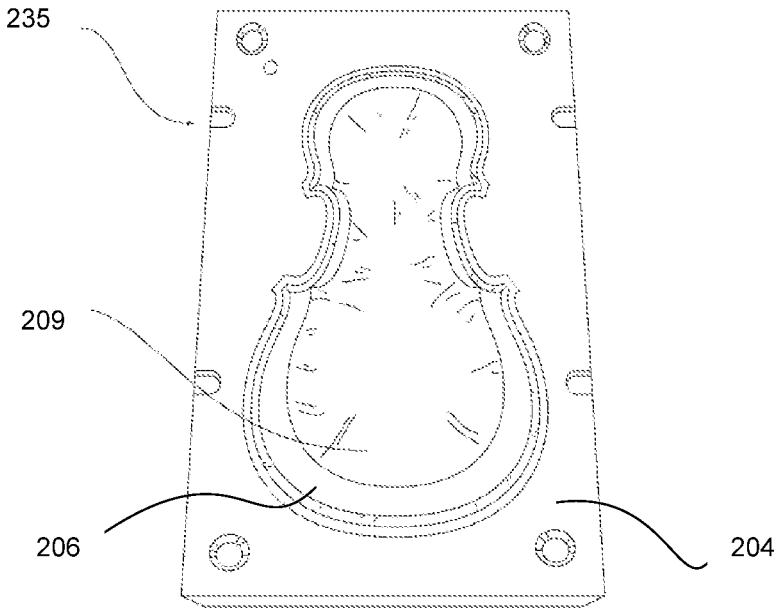
FIG. 2G: Pictorial illustrations of the steps involved in preform.
Figure 2H:
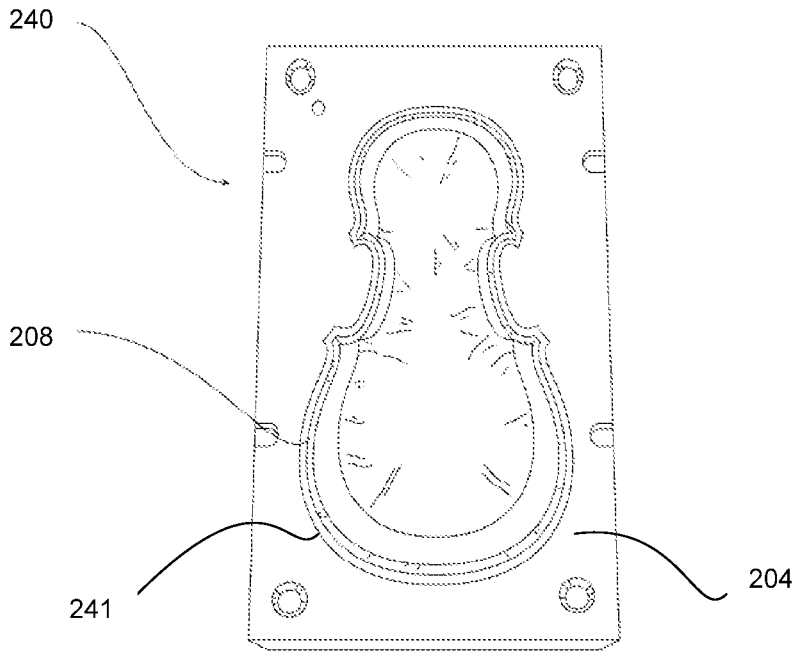
FIG. 2H: Pictorial illustrations of the steps involved in preform.
Figure 2I:
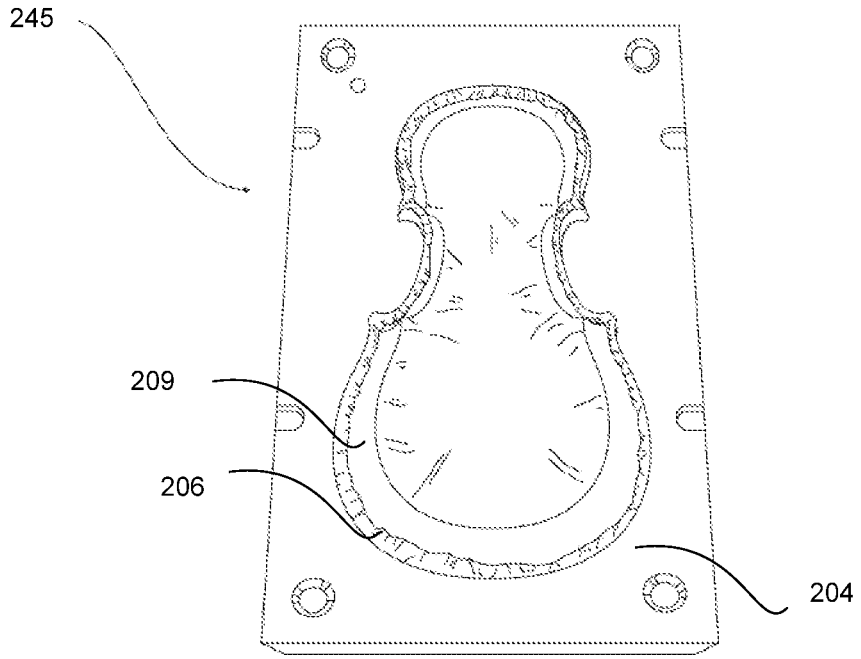
FIG. 2I: Pictorial illustrations of the steps involved in preform.
Figure 2J:
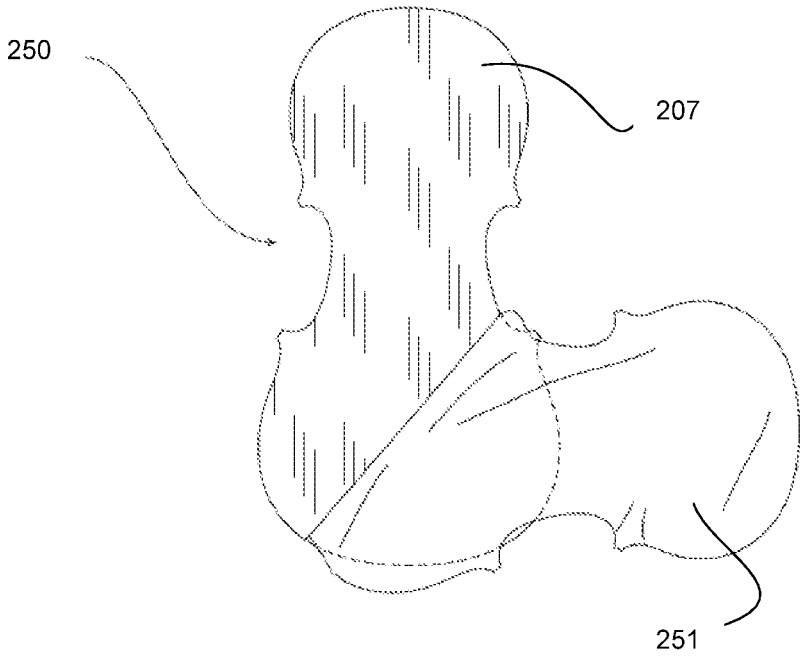
FIG. 2J: Pictorial illustrations of the steps involved in preform.
Figure 2K:
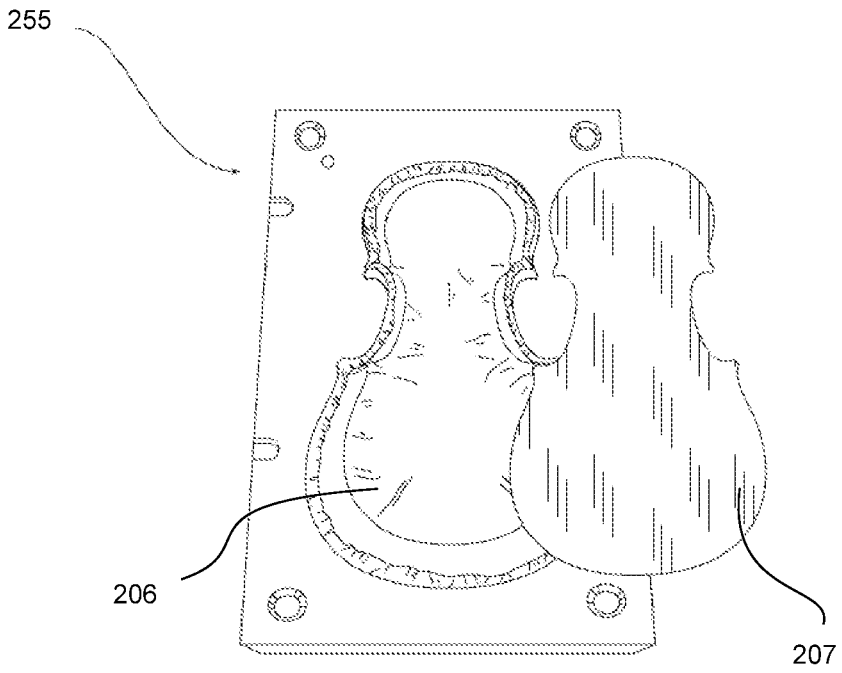
FIG. 2K: Pictorial illustrations of the steps involved in preform.
Figure 2L:
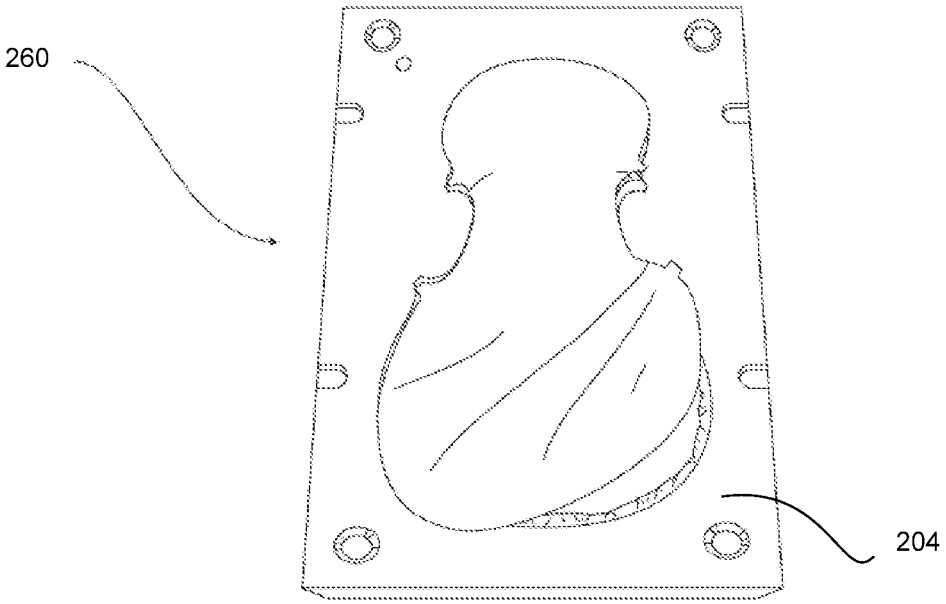
FIG. 2L: Pictorial illustrations of the steps involved in preform.
Figure 2M:
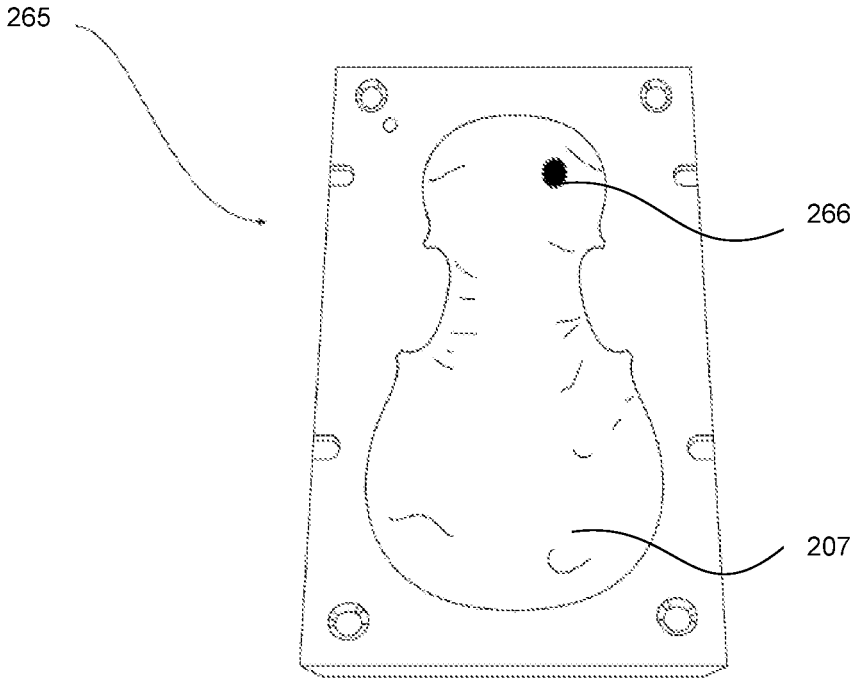
FIG. 2M: Pictorial illustrations of the steps involved in preform.

Referring to FIG. 2-2M, 200-265 illustrate the flow chart and the pictorial representation of the processes involved in preform. As shown in 205 of FIG. 2A, an aluminum mold 204, an outside layer of carbon fiber fabric 206 (hereafter 3K), one inside layer of 3K 207, a strip 208 and the body cutouts of the ½ size expandable foam 209, all of them having the outline shape of the body of the violin are organized at a place for further use (step 200A of FIG. 2). Eight small tabs of 1.0 cm, 211 from the perimeter of the inside layer of 3K 207 is cut (step 200B of FIG. 2) as shown in 210 of FIG. 2B. The red plastic protection cover 216 on the outside layer of 3K 206 is removed (step 200C of FIG. 2) as shown in 215 of FIG. 2C. The outside layer of 3K, 206 with the most resin content is placed on top of the 4/4 aluminum mold 204 (step 200D of FIG. 2) as shown in 220 of FIG. 2D. The outside layer of 3K 206 is warmed with hands using gloves to manually adjust it to the shape of the mold 204 (step 200E of FIG. 2) as shown in 225 of FIG. 2E. The protective cover papers 231 on both sides of the expandable foam 209 are removed (step 200F of FIG. 2) as shown in 230 of FIG. 2F. The expandable foam layer 209 is put in the center of the outside layer of 3K 206 placed on the aluminum mold 204 (200G of FIG. 2) as shown in 235 of FIG. 2G. The strip of the expandable foam 208 cut earlier is placed on the edge 241 of the mold 204 (step 200H of FIG. 2) as shown in 240 of FIG. 2H. The edges of the outside layer of 3K 206 and the foam 209 are all manually adjusted to accommodate all the layers (step 200I of FIG. 2) as shown in 245 of FIG. 2I. The red plastic protection cover 251 of the inside layer of 3K 207 is removed (step 200J of FIG. 2) as shown in 250 of FIG. 2J. The inside layer of 3K 207 is placed on the top of the expandable foam layer 209 (step 200K of FIG. 2) as shown in 255 of FIG. 2K. All the layers are manually adjusted to accommodate each other in place (step 200L of FIG. 2) to get to an arrangement on the mold 204 as shown in 260 of FIG. 2L. A red label 266 with the code for a violin like image is placed on the top of the inside layer of 3K 207 (step 200M of FIG. 2), thus marking that the whole setup is for making a violin as shown in 265 of FIG. 2M.

The second step involves compression molding of plates and ribs. This is a method of molding in which the molding material, generally preheated, is first placed in an open, heated 4/4 aluminum mold cavity. The mold is closed with a top plate of the 4/4 aluminum mold, pressure is applied to force the material into contact with all mold areas, while heat and pressure are maintained until the molding material has cured. The advantage of compression molding is its ability to mold large, fairly intricate parts. In a preferred embodiment, the compression molding step is executed in a temperature range of 270 to 280-degree F. for time period ranging between 2.4-2.6 hours.

Also, it is one of the lowest cost molding methods compared with other methods such as transfer molding and injection molding; moreover it wastes relatively little material, giving it an advantage when working with expensive compounds. Compression molding is a forming process in which a plastic material is placed directly into a heated metal mold, then is softened by the heat, and forced to conform to the shape of the mold as the mold closes. The different mete s for achieving the best results are using the proper amount of material, minimum amount of energy required for heating, minimum amount of time required for heating, appropriate heating techniques, and designing a proper rapid cooling after the material has been compressed into the mold.

The third step involves injection molding some of the components of the stringed musical instrument. The present inventive subject matter describes the usage of 50% carbon filled resins for injection molding some of the components of the stringed musical instrument. The different components being namely, top plate, back plate, ribs, neck, fingerboard, end button, neck block, end block, corner blocks, bass bar, sound post, bridge pegs and tailpiece are molded using injection molding. In a preferred embodiment, the injection molding step is executed in a temperature range of 300-450-degree F. for time period ranging between 1.0-6.0 minutes.

The fourth step involves computer numerical control (CNC) operations, which basically streamlines all the cutting processes that are to be carried out and all the final dimensions are fed into a computer via a program. The computer carries out all the cutting processes. The main purpose of the CNC operations is to trim some of the cured composite at the edges of the desired shapes, so as to give it proper desired shape such as round, rectangular, etc. The computer directs the machine tool to perform various machining operations as per the program of instructions fed.

The fifth step involves sanding and painting to give a final finish to the stringed musical instrument. The purpose of sanding is to remove imperfections and machine marks which effect the finish of the stringed musical instrument. It is desirable to always sand the sand paper with the grain and not against it. For flat and level surfaces a non-flexible sanding block can be used and for contours a flexible sanding block is used. At least three grades namely rough, medium and fine of sandpaper is used prior to painting. Once a smooth surface is obtained a primer is applied followed by the application of a desired colored paint in several coats to achieve a shiny finish.

The sixth step involves to assemble the component parts produced by the above described methods.

Figure 3A:
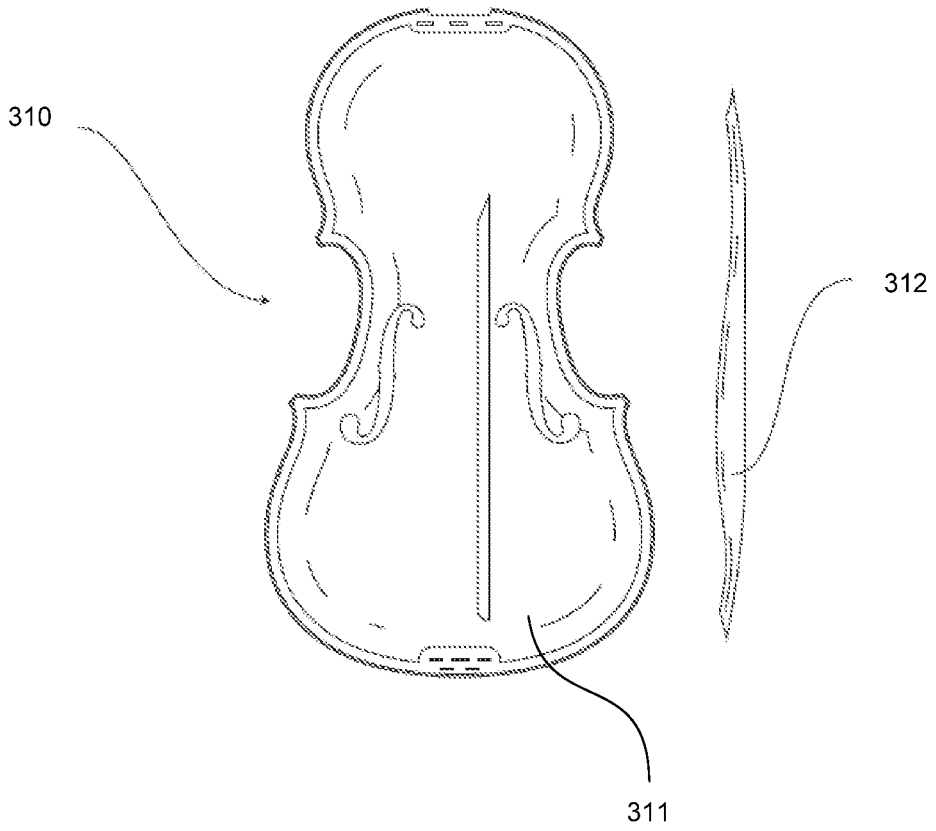
FIG. 3A: Pictorial illustrations of the steps involved in assembling of bass bar.
Figure 3B:
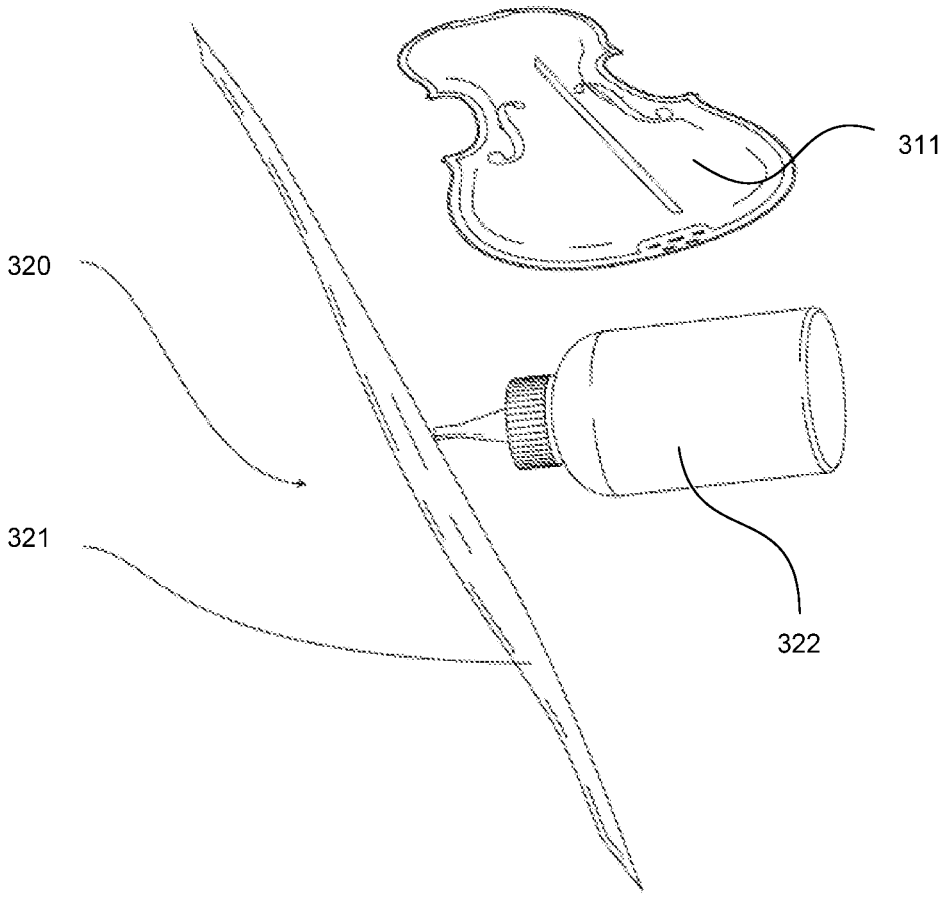
FIG. 3B: Pictorial illustrations of the steps involved in assembling of bass bar.
Figure 3C:
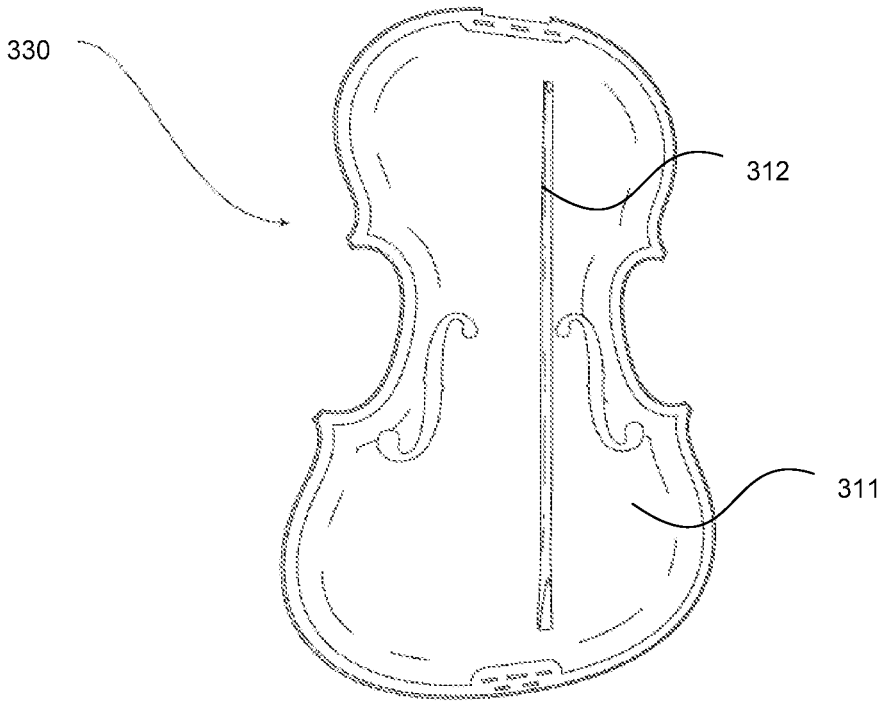
FIG. 3C: Pictorial illustrations of the steps involved in assembling of bass bar.

Referring to FIG. 3A-3C, 310 -330 illustrates the base bar is assembled onto the inside of the top plate of the violin. Firstly, the top plate 311 and the bass bar 312 are organized at a place as shown in 310 of FIG. 3A. An epoxy adhesive 322 is uniformly applied to the bottom surface 321 of the bass bar as shown in 320 of FIG. 3B. The bass bar having the epoxy adhesive on the bottom surface is faced down and placed manually on the inside layer of the top plate and pressed firmly to secure in its position as shown in 330 of FIG. 3C.

Figure 4A:
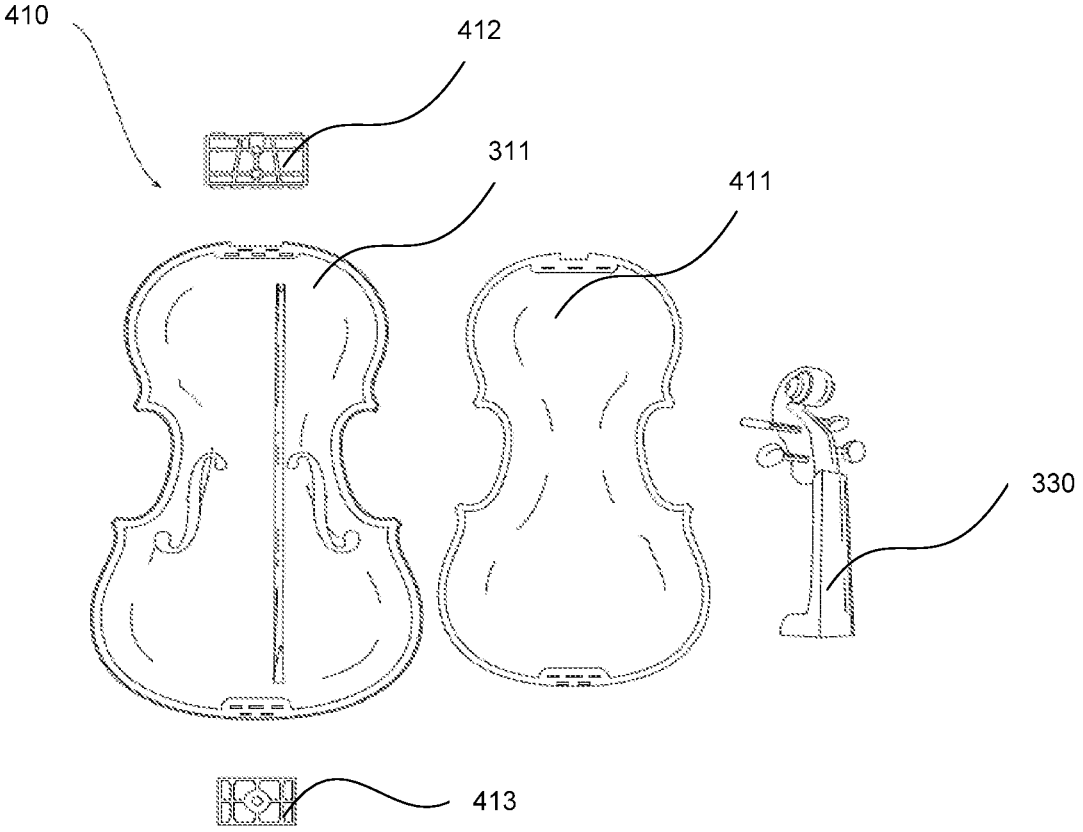
FIG. 4A: Pictorial illustrations of the steps involved in assembling of a neck component.
Figure 4B:
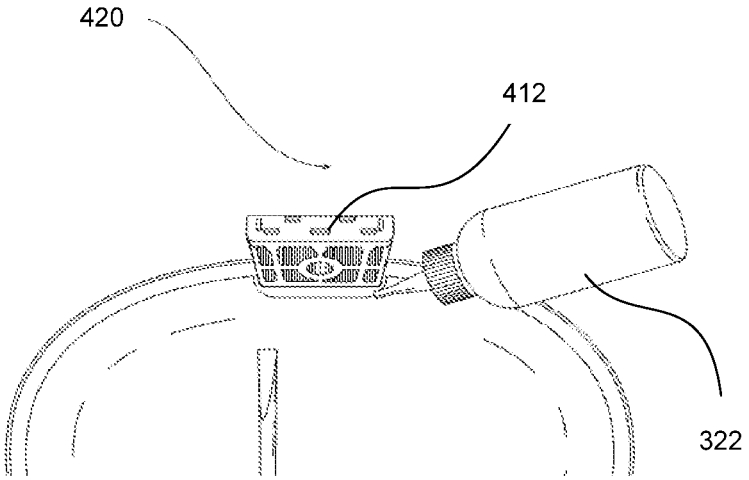
FIG. 4B: Pictorial illustrations of the steps involved in assembling of a neck component.
Figure 4C:
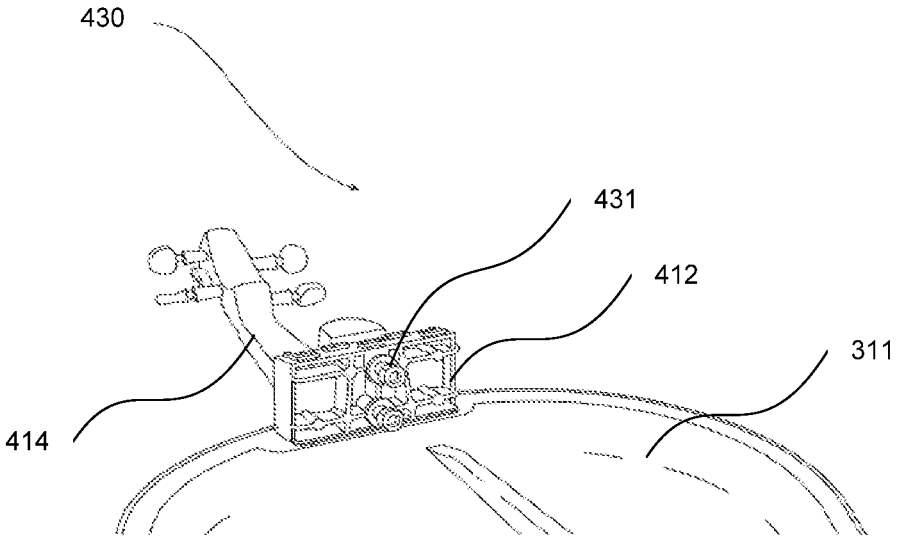
FIG. 4C: Pictorial illustrations of the steps involved in assembling of a neck component.

Referring to FIG. 4A-4C, 410-430 illustrates an assembly of neck attachment to the top plate of the violin. Firstly, all the components to be assembled are placed at a place as shown in 410 of FIG. 4A, namely, the top plate 311, the bottom plate 411, the joints and bolts 412 and 413 and the neck attachment 414. As shown in FIG. 4B, 420 illustrates the attachment of joints 412 with an epoxy adhesive 322. The base of the joints 412 is prepared for receiving the neck attachment by applying the epoxy adhesive 322. The neck attachment 414 is firmly attached to the top plate with the help of joints 412 and bolts 441 as shown in 430 of FIG. 4C.

Figure 5A:
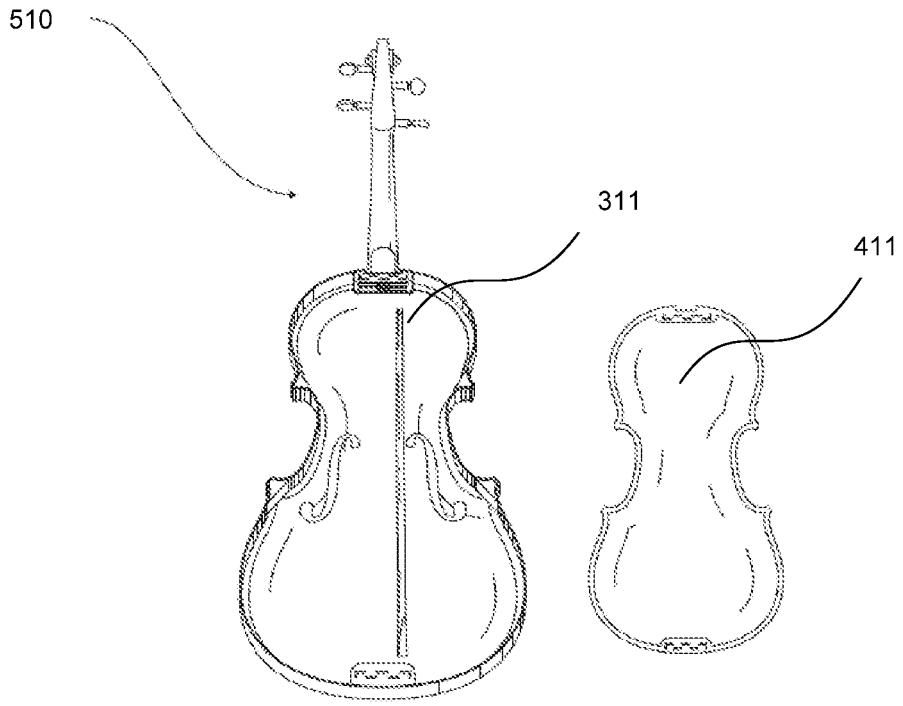
FIG. 5A: Pictorial illustrations of the steps involved in assembling of a top and bottom plates.
Figure 5B:
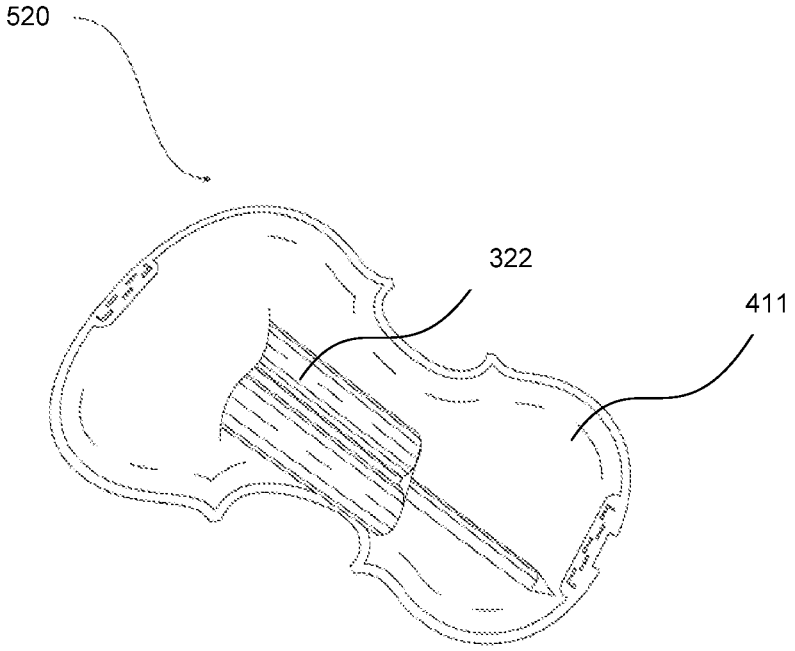
FIG. 5B: Pictorial illustrations of the steps involved in assembling of a top and bottom plates.
Figure 5C:
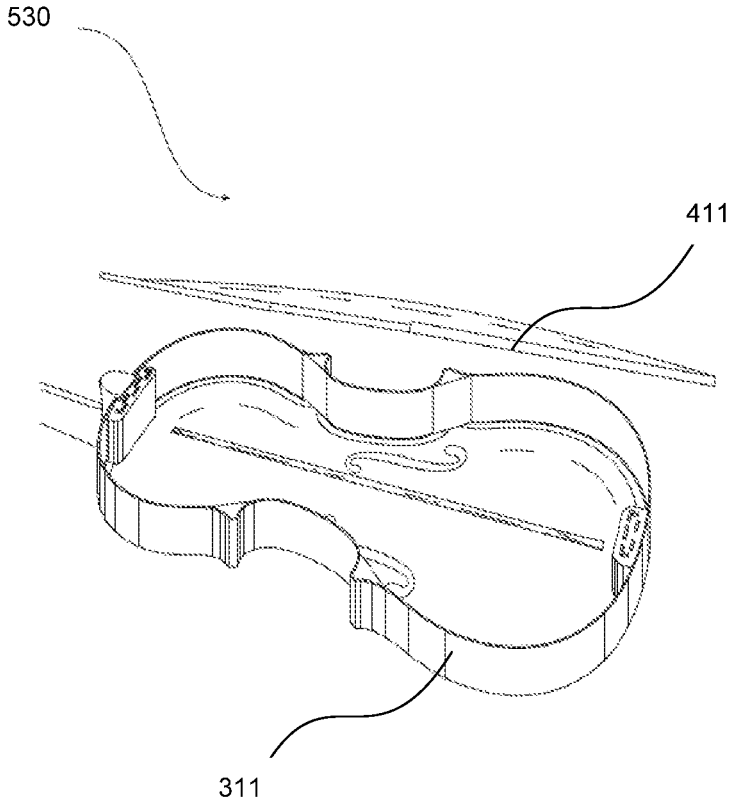
FIG. 5C: Pictorial illustrations of the steps involved in assembling of a top and bottom plates.
Figure 5D:
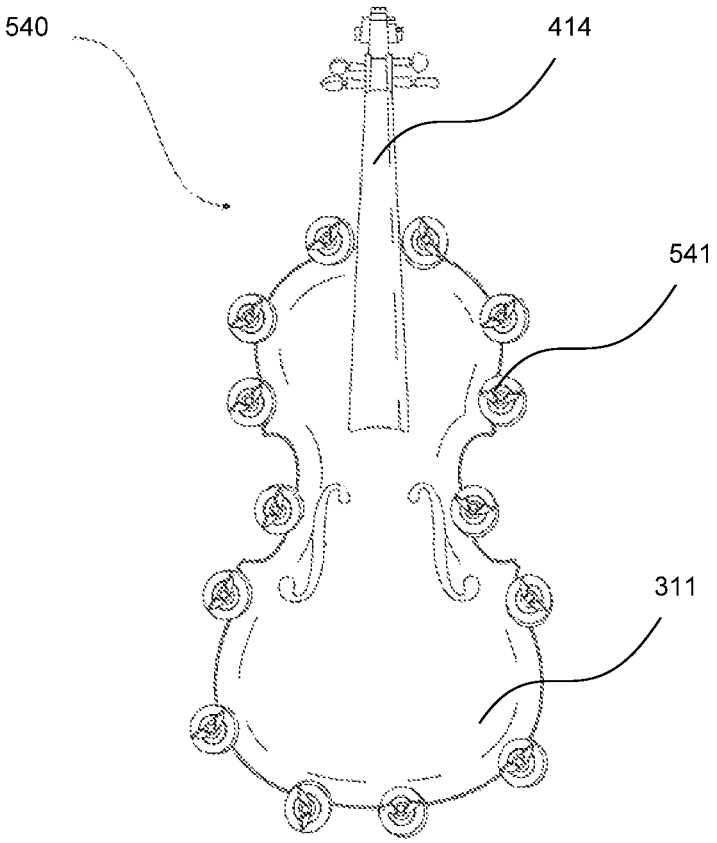
FIG. 5D: Pictorial illustrations of the steps involved in assembling of a top and bottom plates.

The body of the stringed musical instrument is assembled using CNC machined grooves and pockets to accept ribs and tabs on blocks. A unique body unit construction is described herein. Firstly, the bottom plate and the top plate are organized at a place as shown in 510 of FIG. 5A. Epoxy adhesive is uniformly applied to the edges of the inner layer of the bottom plate 411 as shown in 520 of FIG. 5B. The bottom plate 411 with the adhesive edging is faced down and placed on the top plate as shown in 530 of FIG. 5C. Clamps 541 are fixed on the outer edges of the fixed body unit to hold on the bottom 411 and top plates 311 firmly in place as shown in 540 of FIG. 5D.

The last step involves to give a finishing touch by setting up the assembled musical stringed instrument as described above. The process of setting up may be achieved by implementing the following steps in the given sequence: (a) adjust the Truss Rod (b) adjust the Bridge Height (c) check the Nut Height (d) check the Electronics (e) change the Strings (f) check the Tuning Machine Hardware (g) clean and Polish the Frets (h) clean and Oil the Fretboard (i) inspect for Structural Problems (j) adjust the Pickup Height (k) set the Intonation (l) clean and polish.

The other advantage of the present inventive subject matter is the production of stringed musical instruments which are relatively inexpensive, extremely sturdy and of light weight which would help in easy handling of the instrument when played.

It is a primary object of the inventive subject matter to describe a method of making stringed musical instruments which are geometrically identical thus eliminating the fine hand-crafted skills required for carving and constructing a stringed musical instrument. It will be appreciated that when the stringed musical instruments are made identical then one can achieve identical tone characteristics too.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

The invention claimed is:

1. A method for fabricating stringed instruments, comprising:

forming a first preform of a back portion of a body of a musical stringed instrument from a first plurality of pre-cut layers of carbon composite material, wherein the carbon composite material is pre-impregnated with heat-curable resin;

forming a second preform of a front portion of the body of the musical stringed instrument from a second plurality of pre-cut layers of the carbon composite material;

laying up the first preform into a first cavity of a bottom plate of an aluminum tool, wherein the first cavity is a negative impression of the back portion of the body of the musical stringed instrument;

laying up the second preform into a second cavity of the bottom plate of the aluminum tool, wherein the second cavity is a negative impression of the front portion of the body of the musical stringed instrument;

mating a top plate of the aluminum tool with the bottom plate, wherein the top plate is correspondingly shaped to press the first preform and the second preform;

pressing the top plate to the bottom plate of the aluminum tool, wherein a platen press is coupled to the aluminum tool;

heating the platen press to a curing temperature of 270 degrees Fahrenheit to 280 degrees Fahrenheit, for 2.4 hours to 2.6 hours to cure the heat-curable resin pre-impregnated into the carbon composite material; and molding the back portion and the front portion of the body of the musical stringed instrument, each of the back portion and the front portion having an inner geometric configuration and an outer geometric configuration of the body of the musical stringed instrument in which a set of rib grooves and a set of block grooves are formed between, wherein the forming the first preform of the back portion of the body of the musical stringed instrument further comprises:

laying the first plurality of pre-cut layers of carbon composite material into a first mold;

cutting a first perimeter into a plurality of sections;

cutting a first piece of foam into a plurality of strips;

disposing a first set of the plurality of strips of foam on top of the first plurality of pre-cut layers of carbon composite material in a pattern around a second perimeter of the shape of the back portion of the body of the musical string instrument;

disposing a second set of the plurality of strips of foam on top of the first plurality of pre-cut layers of carbon composite material in an incongruous pattern within the pattern around the second perimeter of the shape of the back portion of the body of the musical string instrument;

adjusting each section of the plurality of sections of the first perimeter over the first set of the plurality of strips of foam disposed in a pattern around the second perimeter;

laying up an outside layer of the carbon composite material on top of the first set of the plurality of strips of foam disposed in a pattern around the second perimeter, wherein the outside layer is cut into the shape of the back portion of the body of the musical string instrument, and wherein the first preform is confined within edges of a cavity of the first mold, wherein laying up the second plurality of pre-cut layers of carbon composite material into a second mold;

cutting a first perimeter into a plurality of sections;

cutting a second piece of foam into a plurality of strips;

disposing the plurality of strips of foam on top of the second plurality of pre-cut layers of carbon composite material in a pattern around a second perimeter of the shape of the front portion of the body of the musical stringed instrument;

adjusting each section of the plurality of sections of the first perimeter over the plurality of strips of foam of the second piece of foam disposed in a pattern around the second perimeter;

laying up an outside layer of the second plurality of pre-cut layers of carbon composite material on top of the plurality of strips of foam of the second piece of foam disposed in a pattern around the second perimeter, wherein the outside layer of the second plurality of pre-cut layers of the carbon composite material is cut into the shape of the front portion of the body of the musical stringed instrument, and wherein the second preform is confined within edges of a cavity of the second mold.

2. The method of claim 1, after the forming the second preform of the front portion of the body of the musical stringed instrument from the second plurality of pre-cut layers of the carbon composite material, the method further comprising: storing the first preform and the second preform.

3. The method of claim 1, further comprising:

molding componentry of the musical stringed instrument, wherein the componentry is at least one of:

a neck, a fingerboard, a neck block, and an end block;

molding a first rib, repeating the molding the first rib step for a second rib;

heating the platen press of the first rib to a curing temperature for a curing time sufficient to cure the heat-curable resin pre-impregnated into the carbon composite material;

repeating the heating the platen press step of the first rib for the second rib;

machining the back portion, the front portion, the rib grooves, the block grooves, the neck, the fingerboard, the neck block, the end block, the first rib, and the second rib of the musical stringed instrument;

painting the back portion, the front portion, the rib grooves, the block grooves, the neck, the fingerboard, the neck block, the end block, the first rib, and the second rib of the musical stringed instrument; gluing the first rib and the second rib to the front portion of the body of the musical stringed instrument;

gluing the neck block and the end block on the front portion of the body of the musical stringed instrument; and gluing the front portion having the first rib, the second rib, the neck block, and the end block glued thereto to the back portion.

4. The method of claim 3, wherein the molding componentry step comprises a temperature range of 300 degrees Fahrenheit to 450 degrees Fahrenheit.

5. The method of claim 3, wherein the molding componentry step comprises a time period ranging between 1.0 minutes to 6.0 minutes.

6. The method of claim 3, wherein each of the gluing steps comprises an epoxy adhesive.

7. The method of claim 3, wherein the molding componentry step comprises injection molding.

8. The method of claim 3, further comprising fitting the neck, wherein a tapered bottom end of the neck is received by an opening in the neck block of the body of the musical stringed instrument; and aligning the neck;

wherein the neck is fastened to the neck block of the body of the musical stringed instrument.

9. The method of claim 3, wherein the fingerboard comprises approximately 50% carbon composite material.

10. The method of claim 1, wherein the musical instrument is at least one of a violin, viola, cello, bass guitar, double bass guitar, guitar, sitar, mandolin, and ukulele.

11. The method of claim 1, wherein the first mold comprises a first boundary in the shape of the back portion of the body of the musical stringed instrument marked around the edges of the cavity of the first mold.

12. The method of claim 1, wherein the second mold comprises a second boundary in the shape of the front portion of the body of the musical stringed instrument marked around the edges of the cavity of the second mold.

* * * * *